United States Patent [19]

Koguchi

[11] Patent Number: 4,636,177

[45] Date of Patent: Jan. 13, 1987

[54] PLAYING ANIMAL TOY

[75] Inventor: Noriyuki Koguchi, Koshigaya, Japan

[73] Assignee: Iwaya Corporation, Tokyo, Japan

[21] Appl. No.: 706,141

[22] Filed: Feb. 27, 1985

[30] Foreign Application Priority Data

May 28, 1984 [JP] Japan ..... 59-108120

[51] Int. Cl.[4] ..... A63H 1/00

[52] U.S. Cl. ..... 446/236; 446/298; 446/353

[58] Field of Search ..... 446/298, 303, 297, 326, 446/322, 236, 265, 238, 237, 259, 288, 269, 270, 275, 279, 409, 491, 352–354

[56] References Cited

U.S. PATENT DOCUMENTS 2,581,584 1/1952 Fields ..... 446/326
3,260,016 7/1966 Goldfarb ..... 446/354
4,225,138 9/1980 Wolf ..... 446/330 X
4,389,811 6/1983 Iwaya et al. ..... 446/298 X

FOREIGN PATENT DOCUMENTS 784460 10/1957 United Kingdom ..... 446/279

*Primary Examiner*—Mickey Yu
*Attorney, Agent, or Firm*—James E. Niles

[57] ABSTRACT

A playing animal toy wherein a rotary vessel is mounted rotatably on a floor engaging member having a bottom surface. The rotary vessel has a projecting edge for touching the floor which is larger in diameter than the bottom surface and disposed above it. A toy is disposed movably back and forth within the rotary vessel and formed in imitation of a desired animal. The rotary vessel is moved by a swinging device to swing back and forth with the swinging motion of the toy so that one portion of the projected edge of the rotary vessel is brought in touch with floor.

6 Claims, 17 Drawing Figures

PLAYING ANIMAL TOY

BACKGROUND OF THE INVENTION

1. Field of the Invention

The present invention relates to a playing animal toy and particularly relates to such a toy which provides a situation in which a toy means appears to be playing, riding in a vehicle.

2. Description of the Prior Art

Conventionally, there have been proposed a wide variety of toys of this kind, some of which are, for example, a toy in imitation of a desired animal which imitates the behavior of said animal by itself, an animal toy which mimics playing a musical instrument, an animal toy which rides in a vehicle such as a car to mimic driving a car, and so on.

Such toys, however, often aim at attracting interest in the action of the toy means itself or in motion of the vehicle in which the toy rides. Especially in toys consisting of toy means and playing means, it could be said that they lack unity between the toy means and the playing means, and that they have a problem in their mechanism of providing realistic motion whereby the toy means plays with the playing means.

SUMMARY OF THE INVENTION

It is, therefore, an object of the present invention to overcome the above disadvantage and limitation of the prior art.

It is also an object of the present invention to provide a new and improved animal playing toy, in which action of a toy animal or similar figure appears to cause movement of a rotary vessel as a playing means, and the figure and the rotary vessel can move as one united body, so that a situation is provided in which it appears as if the figure rides in the rotary vessel and enjoys itself by controlling the rotary vessel.

The above and other objects are attained by the present animal playing toy comprising:

a floor engaging means having a nearly oval bottom surface;

a rotary vessel mounted rotatably on the floor engaging means, said rotary vessel having a projecting annular ridge for touching the floor which is of larger diameter than said bottom surface and disposed above said bottom surface;

a figure disposed movably back and forth within said rotary vessel and made in imitation of a desired animal;

a swinging mechanism for swinging said rotary vessel back and forth concurrently with the swinging motion of the figure and for bringing one portion of said projecting ridge of the rotary vessel into contact with the floor;

a driving mechanism positioned within the rotary vessel for driving and rotating said floor engaging means.

The present animal playing toy can also comprise:

a floor engaging means in contact wtih the floor having a nearly oval bottom surface;

a rotary vessel mounted on said floor engaging means rotatably and movably, said rotary vessel having a projecting annular ridge for engaging the floor which is of larger diameter than said bottom surface and is disposed above said bottom surface;

a figure disposed movably back and forth within said rotary vessel, formed in imitation of a desired animal having two arm means on both sides thereof and a mechanism associated therewith which can produce sound;

a swinging mechanism for swinging said rotary vessel back and forth concurrently with the swinging motion of the figure and for bringing one portion of said projecting ridge of the rotary vessel into contact with the floor;

a driving mechanism disposed within said rotary vessel for driving and rotating said floor engaging means;

an up and down mechanism disposed within said figure movably up and down for actuating the arm means on the both sides of the figure and the sound producing mechanism almost simultaneously; and a cam means coupled to said up and down mechanism through a power switching mechanism, and rotated by the output from said driving mechanism.

The other obejcts and characteristics of the present invention will be described in accordance with the appended drawings.

DESCRIPTION OF THE PREFERRED EMBODIMENT

Figure 1:
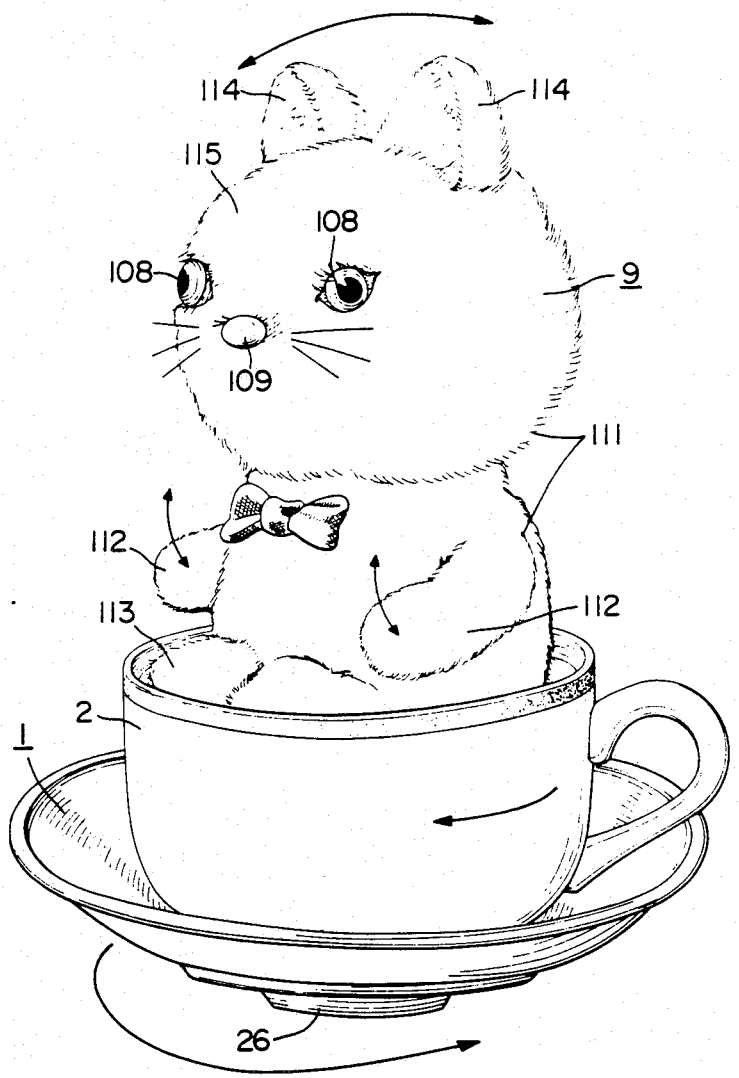
FIG. 1 is a front perspective view that shows the appearance of the present playing animal toy.
Figure 2:
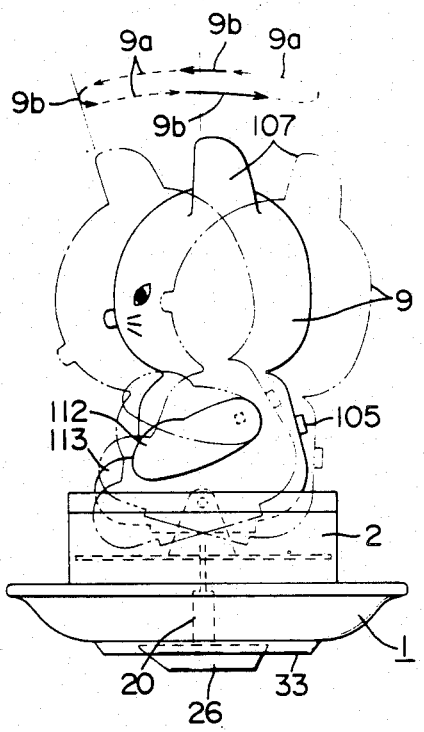
FIG. 2 is a side view of the present playing animal toy.
Figure 3:
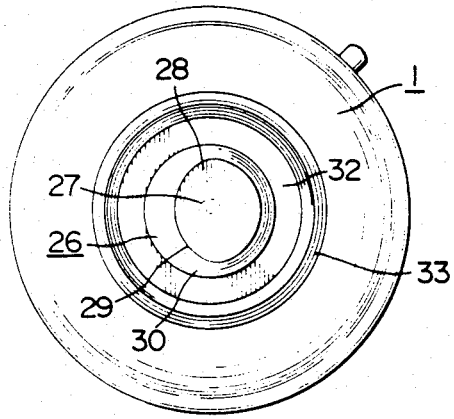
FIG. 3 is a bottom view of the present playing animal toy.
Figure 4:
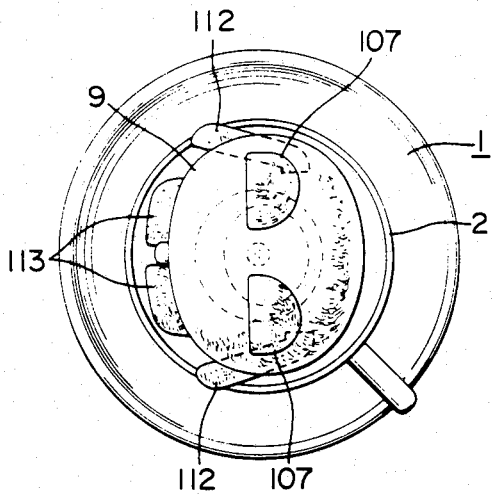
FIG. 4 is a plan view of the present playing animal toy.
Figure 5:
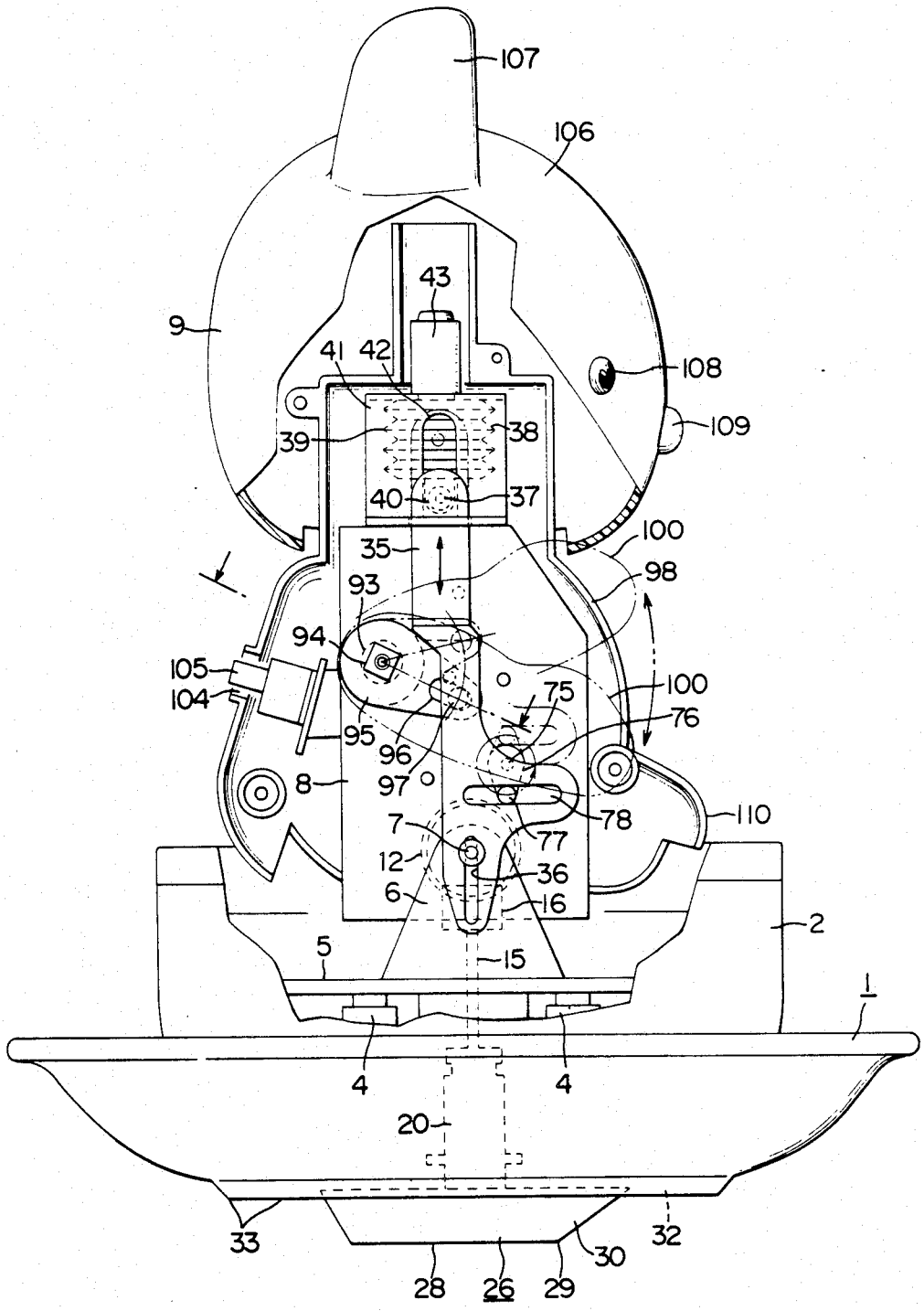
FIG. 5 is a view of one side of the present playing animal toy with portions shown cut away.
Figure 6:
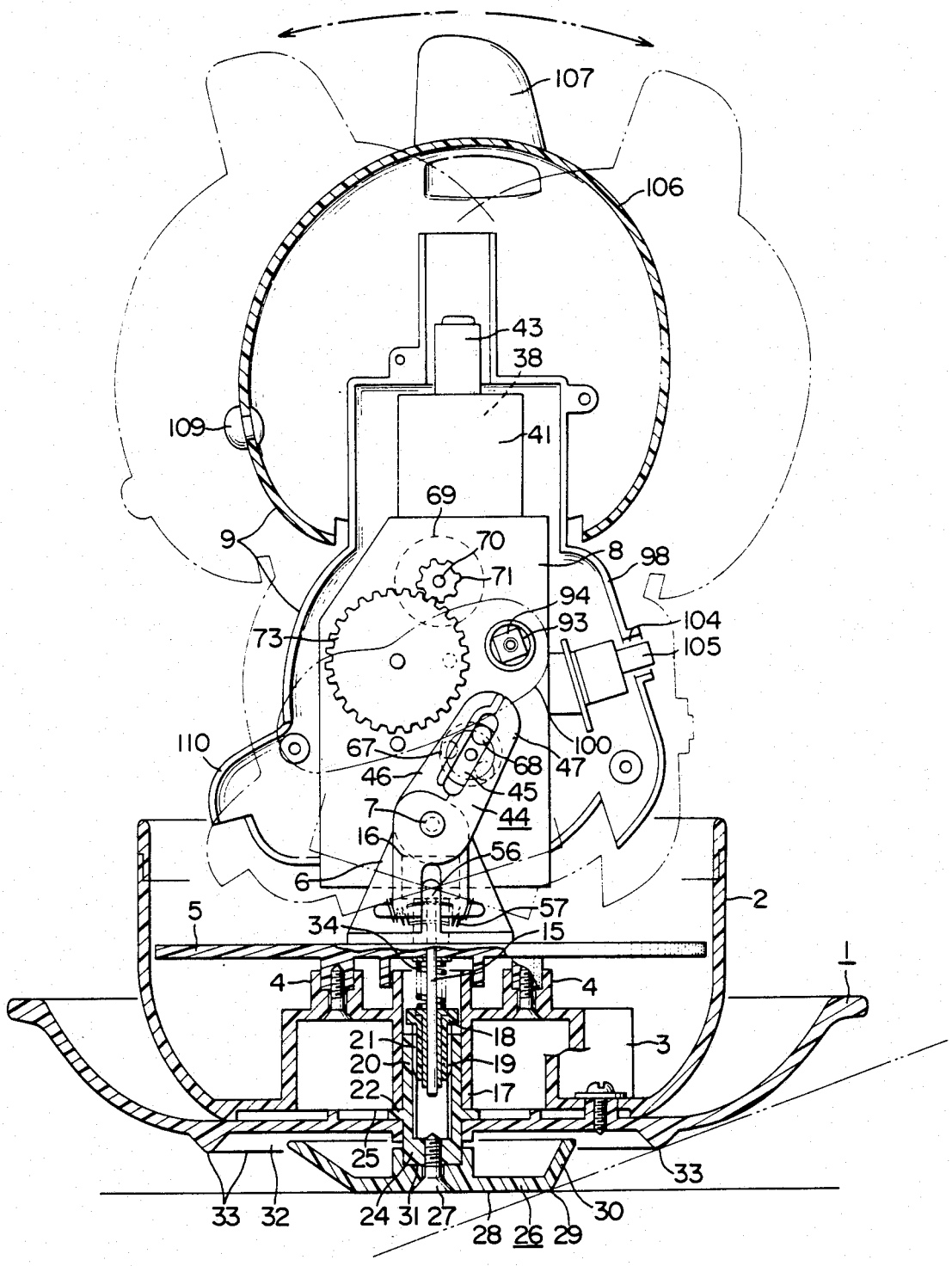
FIG. 6 is a view in vertical section from the other side of the present playing animal toy.
Figure 7:
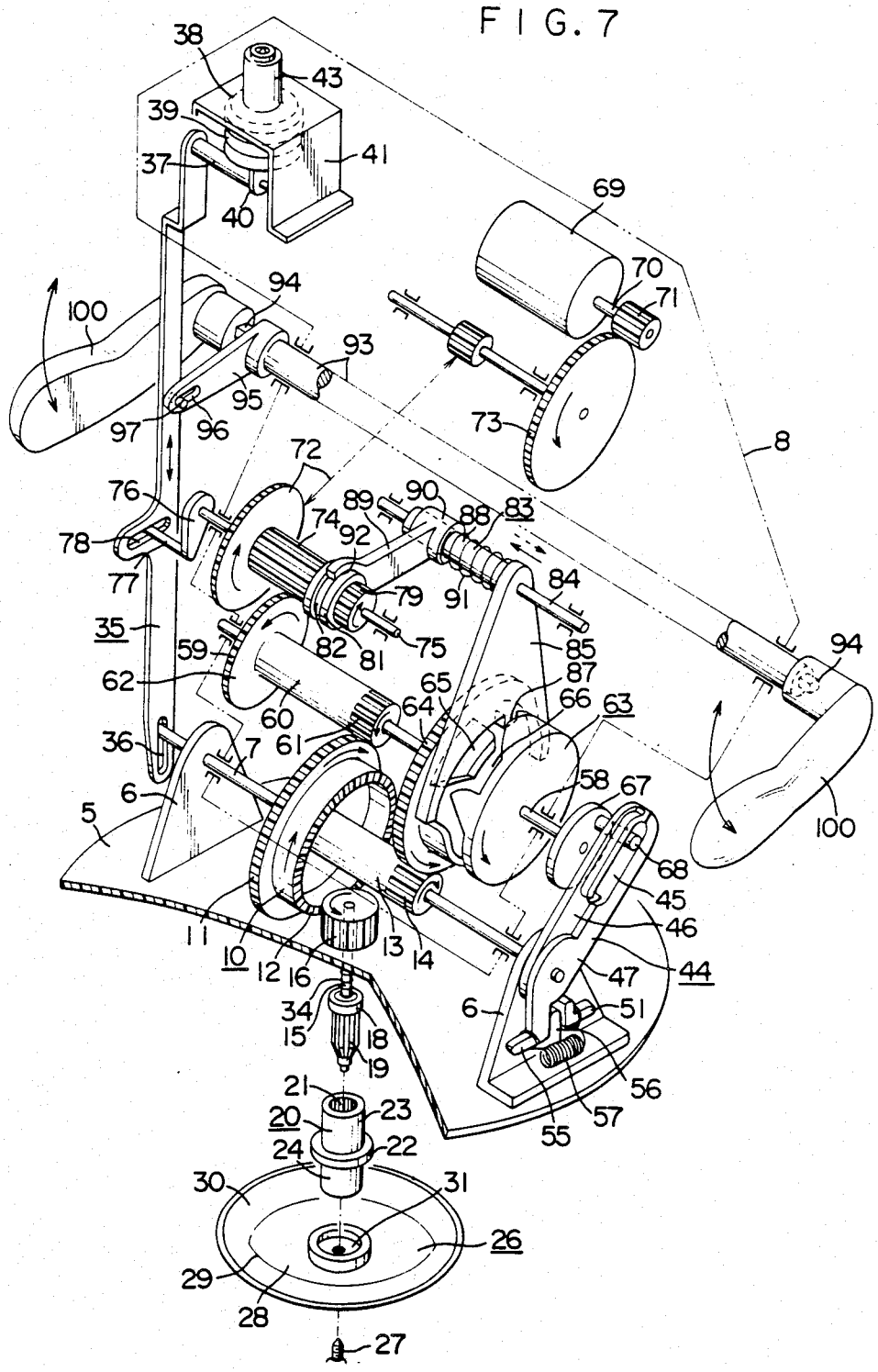
FIG. 7 is a disassembled perspective view of the internal mechanism of the present playing animal toy.
Figure 8:
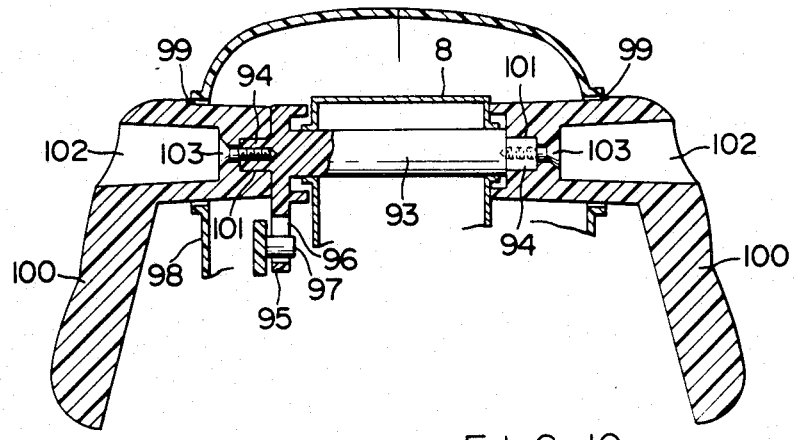
FIG. 8 is a cross-sectional view of an arm frame fixing mechanism portion.
Figure 10:
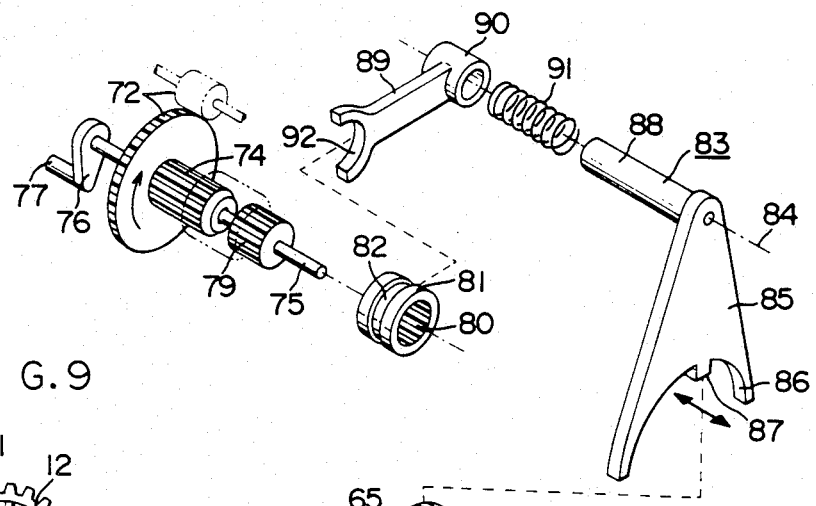
FIG. 10 is a disassembled view of a power switching mechanism of the present playing animal toy.

In the figures, reference numeral 1 is a saucer portion of a rotary vessel made from, for example, synthetic resin in imitation of a coffee saucer, and 2 is a cup portion of the rotary vessel which is also made from, for example, synthetic resin in imitation of a coffee cup, and is fixed removably to the saucer portion 1. The cup portion 2 has a cell case 3 at the bottom thereof, in which dry cells are housed. The cell case 3 has a plurality of bosses 4 on which a mounting plate 5 is secured.

Figure 9:
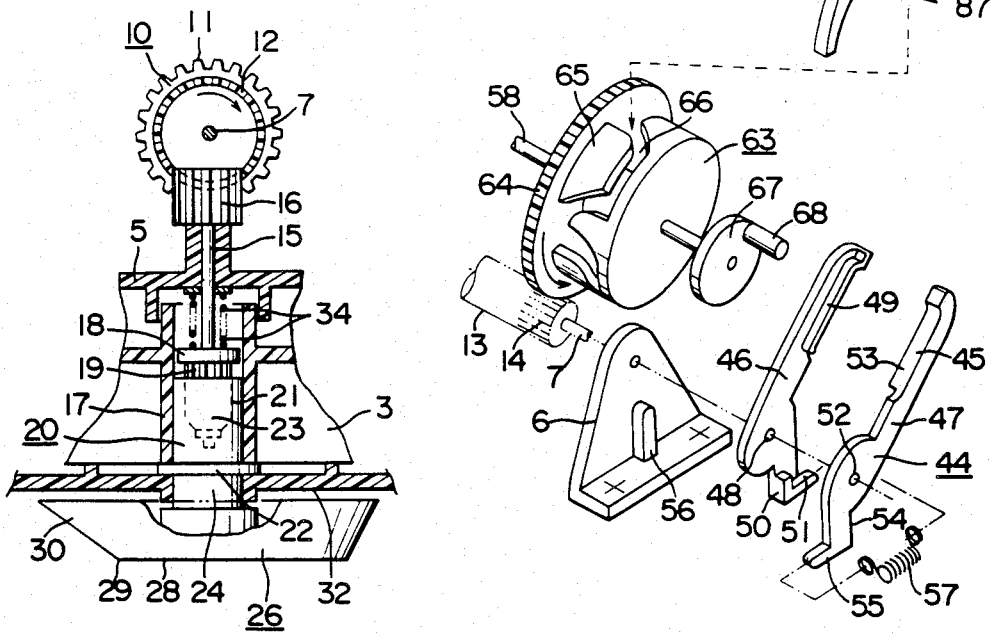
FIG. 9 is a view in vertical section of a rotary mechanism of the present playing animal toy.

Projecting up from the top surface of said mounting plate 5, near opposite sides of it, there are fixed two brackets 6, which are nearly triangular in shape and which flatwise oppose each other and rotatably support a base shaft 7. This base shaft 7 rotatably supports a frame 8 which is incorporated integrally in the FIG. 9 made in imitation of the desired doll or animal. To said base shaft 7, a drive gear means 10 is also fixed for rotation, to serve as a driving mechanism. The drive gear means 10 consists of an input gear 11, a crown gear 12 which is integral with the input gear 11, and an output gear 14 which is also disposed integrally with the input gear 11 and connected with it by an axial spacer 13. Further, a rotatable shaft 15 extends perpendicularly through the center portion of said mounting plate 5, acting as a rotational driving mechanism. To the top of this rotatable shaft 15 is fixed a relay gear 16 that meshes with the crown gear 12 of said drive gear means 10. The lower part of the rotary shaft 15 projects into a hollow guide tube 17 which is formed within said cell case 3. To the lower portion of the rotary shaft 15, a spline shaft 19 with a flange 18 is fixed integrally, to which an upper portion of a coupling means 20 is a spline-fitted through a grooved tube 21 of the spline. The coupling means 20 has a flange 22 with a large diameter in its middle portion. This flange 22 is disposed rotatably within a guide groove 25 formed between the bottom of said saucer portion 1 and the bottom of said cup portion 2. Above the flange 22 the coupling means has a guide portion 23 which is inserted rotatably through said guide tube 17. Below the flange 22, a coupling portion 24 is formed, projecting downward from the bottom of said saucer portion 1.

The coupling portion 24 of the coupling means 20 is fixed integrally to a rotary floor engaging means 26 by means of a screw 27. The floor engaging means 26 is made from, for example, synthetic resin, and has a bottom surface 28 of an oval shape. Around the outer periphery 29 of the oval bottom surface 28, and projecting up from it, a peripheral side portion 30 is formed integrally with the bottom surface 28. Further, the floor engaging means has a fitting portion with an upwardly opening cavity 31, at the eccentric center of the whole toy body. The coupling portion 24 of said coupling means 20 is fitted to the fitting portion 31 and secured to it by means of the screw 27 so as to secure the floor engaging means 26 to the coupling means 20. Further, a downwardly opening cavity 32 having a larger diameter than the floor engaging means 26 is formed at the bottom of the saucer portion 1. At the periphery of this cavity 32, a ring-shaped ridge 33 for touching the floor is formed integrally with the saucer portion. Further, said rotary shaft 15 is wound with a coil spring 34 between said mounting plate 5 and said flange 18 of said spline shaft 19.

The lower end portion of an up and down piece 35 is confined to up and down motion by a vertically elongated guide groove 36 therein through which one end of the base shaft 7 slidably and rotatably extends. This up and down piece 35 is movable upward and downward along said frame 8, and has a connecting rod 37 at its top end that projects almost horizontally from it. At one end of the connecting rod 37, a projecting piece 40 is fixed, which projects into a bellows 39 of a sound producing means 38. The sound producing means 38 is fixed to a support frame 41 disposed at the top of said frame 8. The support frame 41 has a vertically elongated guide hole 42 on one side, through which said connecting rod 37 is inserted movably up and down. According to the movement of the up and down piece 35, the bellows 39 of the sound means 38 is contracted or expanded which causes a pipe means 43 to mew.

At the other end of said base shaft 7, a base of a support arm 44 consisting of, for example, synthetic resin is fixed as a swinging mechanism. The support arm 44 has an elongated guide hole 45 in the longitudinal direction at the top end thereof. This support arm consists of a first arm piece 46 and a second arm piece 47. The first arm piece 46 has a through-hole 48 at its base portion, through which said base shaft 7 is inserted rotatably and axially movably. The first arm piece 46 also has a hollow cut portion 49 in the longitudinal direction on one side of its top portion and a projected piece 51 on one side of its lower end portion, which is formed integrally with the arm piece 46 through a vertical portion 50. The second arm piece 47 has a through-hole 52 at its base portion, through which said base shaft 7 is inserted rotatably and axially movably. The second arm piece 47 also has a hollow cut portion 53 on one side of its top portion, and a projected piece 55 on the one side of its lower end, which is formed integrally with the arm piece 47 through a vertical portion 54. The hollow cut portion 49 together with the hollow cut portion 53 form said elongated guide hole 45. The base shaft 7 is inserted rotatably and axially movably through the first and second arms 46 and 47. These arms 46 and 47 are secured by having their vertical portions 50 and 54 engaging each other putting a vertical stopper 56 projecting at the center of the outer side of the bracket 6 therebetween. At the same time, both ends of a coil spring 57 are fixed to projected pieces 51 and 55, respectively, thereby supporting the elongated hole 45 between both cut portions 49 and 53 elastically. This elongated guide hole 45 can expand a little when it is subjected to stress against the coil spring 57.

Next, a movable rotary shaft 58 is rotatably supported by the frame 8 as a swinging mechanism. Near one end of the rotary shaft 58 it carries a reduction gear 59, a spacer 60, and a gear means 62 having an interlock gear 61 engaged with said input gear 11, all rotatable relative to the shaft 58. To the other end of the shaft 58, a drum-like cam means 63 is fixed integrally. This cam means 63 has a reduction gear 64, which engages the output gear 14 of said drive gear means 10, along its outer periphery. At the outside of the reduction gear 64, a ring-shaped drum portion 65 with a smaller diameter than the gear 64 is formed integrally. The outer peripheral surface of the drum portion 65 is provided with a grooved cam 66 in nearly a zigzag line. Further, a disk 67 is fixed integrally to the outer end of the movable rotary shaft 58, which has a solid crank arm 68 projecting from the eccentric position thereof as a swinging mechanism. The crank arm 68 is inserted through and slidably engaged in the elongated guide hole 45 of said support arm 44.

Further, a motor 69 is fixed to said frame 8. This motor 69 is provided with a pinion 71 at its output shaft 70, to which a reduction input gear 73 of a gear interlock mechanism 72 is engaged. An output gear 74 of this gear interlock mechanism 72 is supported by a relay shaft 75, relative to which it is rotatable. The relay shaft 75 is rotatably supported by said frame 8. Said output gear 74 engages the reduction gear 59 of said gear means 62. Said relay shaft 75 has a crank arm 77 fixed at one end that projects from the end of the shaft 75 through a link 76 and passes rotatably and movably through a guide groove 78 elongated in the transverse direction in the middle of said up and down piece 35. Also fixed on the relay shaft 75 is a transmission gear 79, upon which an axially sliding clutch means 81 is fitted as a tubular clutch which has an internal spline 80 for drivingly connecting gears 79 and 74 with each other, and for detaching the interlock between these gears. The sliding clutch means 81 is provided with a circumferential groove 82 in its outer periphery in the middle thereof.

Further, a power switching mechanism 83 is provided to the frame 8. The power switching mechanism 83 has an actuation plate 85 of a nearly triangular shape with its top portion fixed to a support shaft 84 which extends across the frame 8. At its wider bottom the actuation plate 85 has a concavely arcuate edge portion 86 facing the drum portion 65 of said cam means 63. In the middle of this edge portion 86, there projects a guide 87 which is inserted slidingly into the grooved cam 66 of said drum portion 65. Slidable on said support shaft 84 is a tubular spacer 88. The top end of said actuation plate 85 is fixed to one end of this spacer 88. To the other end of this spacer 88, a base end portion 90 of a support arm 89 is slidably and rotatably fitted. The spacer 88 is wound with a coil spring 91 between the base end portion 90 of the interlock arm 89 and the actuation plate 85. Further, a fork 92 is formed in an arc shape at the top end portion of said support arm 89, engaging the groove 82 of said sliding clutch means 81.

Next, an arm shaft 93 is rotatably supported by the upper portion of the frame 8. At both ends of this arm shaft 93, rectangular-shaped projections 94 are formed integrally. Near one end of the arm shaft 93, an interlock piece 95 is formed integrally. The interlock piece 95 has an elongated hole 96 at its outer end through which a connecting rod 97 projecting from said up and down piece 35 is slidably received. Further, guide through-holes 99 are formed on a body frame 98 of the toy means 9, respectively, at the positions facing said rectangular-shaped projections 94 at both ends of the arm shaft 93. Both base portions of two arm frames 100 have hollow portions 101, respectively, which are fitted onto said rectangular-shaped projections 94 through said guide through-holes 99. Both base portions are, then, secured to the rectangular-shaped projections 94 by means of screws 103, respectively, which are inserted from through-holes 102 formed in the base portions of the arm frames 100. At the back of the body frame 98 of the toy means 9, a guide hole 104 is formed in which a switch 105 is disposed for electrically connecting the motor 69 and cells within said cell case 3. Further, a head frame 106 having ear frames 107, eyes 108, and a nose 109 is fixed to the top of the body frame 98 of the toy means 9, and leg frames 110 are formed in the lower portion of the body frame 98. Then, the whole body of the toy means 9 is covered with a fur-like cover means 111, so that the toy means 9 comprising two arm means 112 on both sides, two leg means 113, two ear means 114, and a face means 115 is formed to appear as if it were riding in the cup means 2.

The operation of the present invention will be described hereinafter.

When the switch 105 is turned on, the motor 69 is actuated and rotates the pinion 71 of the output shaft 70. As the pinion 71 rotates, the reduction output gear 73 of the gear interlock mechanism 72, which engages the pinion 71, is also rotated. Then, the output gear 74 of the gear interlock mechanism 72 is rotated and rotates the reduction gear 59 of the gear means 62. Further, as the reduction gear 59 rotates, the interlock gear 61 which is coupled to the gear 59 through the spacer 60 is also rotated and rotates the driving gear means 10, as the input gear 11 of said driving gear means engages the gear 61.

Further, as the driving gear means 10 rotates, the crown gear 12 which is formed integrally with the driving gear means 10 is also rotated and rotates the rotary shaft 15 through the relay gear 16 which engages the crown gear 12. Then, the rotary shaft 15 rotates the coupling means 20 which is spline-fitted to the shaft 15 through the spline shaft 19. The coupling means 20 then rotates the floor engaging means 26 which is fixed to the coupling means 20 by means of the screw 27.

Further, as the driving gear means 10 rotates, the output gear 14 formed integrally with the driving gear means 10 through the spacer 13 is also rotated which, in turn, rotates the cam means 63 through the reduction gear 64 that engages the output gear 14, and also rotates the rotary shaft 58 to which the cam means 63 is fixed. Further, as the movable rotary shaft 58 rotates, the crank arm 68 projecting from the disk 67 is rotated by it. As the crank arm 68 moves up and down, while rotating, within the elongated guide hole 45 of the support arm 44, the whole body of the toy means 9 incorporating the frame 8 therewithin swings forward and backward around the base shaft 7 which supports the frame 8 and is supported by the brackets 6.

Further, as the toy means 9 swings forward and backward, it imparts corresponding swings to the saucer portion 1 and the cup portion 2 which are formed integrally and provided with toy means 9 therewithin, and the movable rotary means 26 which is rotated with its bottom surface 28 engaging the floor also swings in the same manner, so that the toy means 9 is supported by one portion of the ring-shaped ridge 33 of the saucer portion 1 and one portion of the peripheral edge 29 of the bottom surface 28 of the floor engaging means 26, while being rotated swingingly by the floor engaging means 26.

Since the bottom surface 28 of the floor engaging means 26 is formed in nearly an oval shape, and its peripheral edge 29 is also formed in nearly an oval shape, when the floor engaging means 26 is rotated in the inclined state, each portion of the ridge 33 of the saucer means 1 rotates around the peripheral edge 29 so that the whole body of the toy means 9 is moved and gyratorily rotated irregularly.

Figure 13:
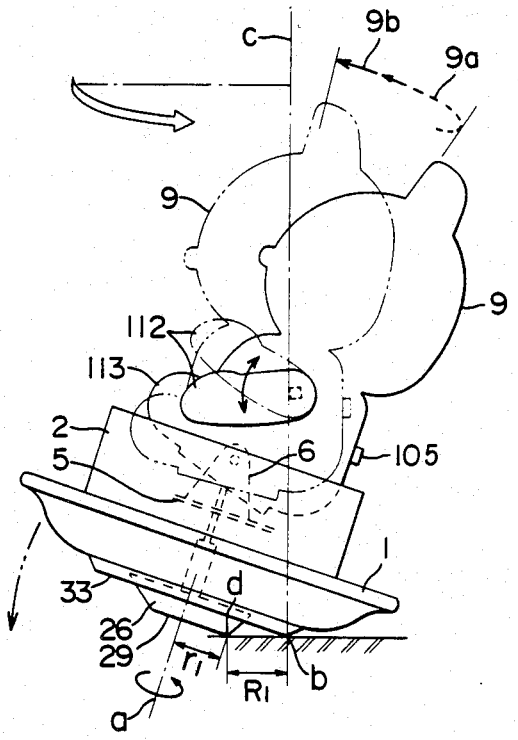
FIG. 13 through FIG. 15 are diagrammatic side views showing the operation of the toy.

The toy means 9 is gyratorily rotated at a higher speed with a small radius in the state shown in FIG. 13, in which the toy means 9 is inclined backward, the rotation center a of the toy means 9 is shifted relative to a turning axis c extending through a point b where the back portion of the ridge 33 of the saucer portion 1 touches the floor, there is a relatively small distance R1 between said point b and a point d where the peripheral edge 29 of the bottom surface 28 of the floor engaging means 26 touches the floor, and there is a relatively large distance r1 between the point d and said rotation center a.

Figure 14:
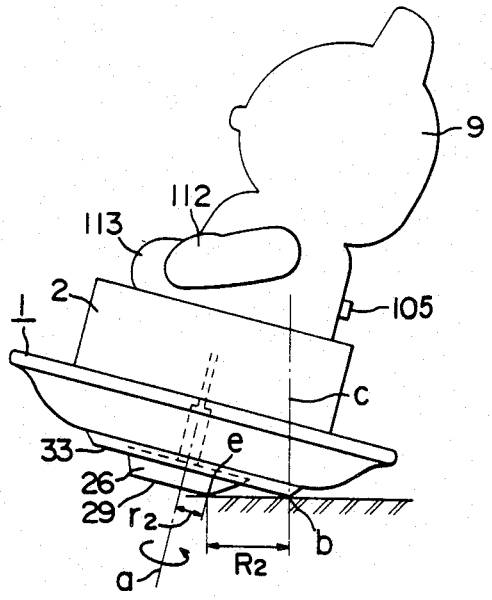

The toy means 9 is gyratorily rotated at a lower speed with a larger radius in the state shown in FIG. 14, in which the rotation center a of the toy means 9 is shifted relative to the turning axis c that extends through the point b where the ridge 33 of the saucer portion 1 touches the floor, and the distance R2 between the point b and a point e where the peripheral edge 29 of the bottom surface 28 of the floor engaging means 26 touches the floor is relatively larger than said distance R1 in FIG. 13, while the distance r2 between said point e and the rotating center a is relatively less than the distance r1 in FIG. 13.

Further in this case, the cam means 63 is continuously rotated by the output gear 14, and the movable rotary shaft 58 to which the cam means 63 is fixed is also rotated, so that the toy means 9 continues to swing forward and backward around the base shaft 7 by the rotation of the crank arm 68 of the shaft 58.

The swinging motion of the toy means 9, the inclining motion of the cup portion 2 housing the toy means 9 therewithin, the saucer portion 1 coupled to the cup portion 2 integrally, and the continuous rotation of said floor engaging means 26 cooperatively rotate and move the saucer portion 1, bringing each portion of the ridge 33 of the saucer portion into contact with the floor, sequentially, as the point b. According to this motion of the saucer portion 1, the floor engaging means 26 also rotates and swings, bringing each portion of the peripheral edge 29 of its bottom surface 28 into contact with the floor sequentially.

Accordingly, it should be understood that the toy means 9 gyratorily rotates and swings always in the inclined state toward one side, said swing sometimes being a large motion and sometimes a small motion due to the irregular repetition of large and small amplitude.

Further in this case, namely when the cam means 63 is rotated through its reduction gear 64, which meshes with the output gear 14, the grooved cam 66 which is formed in the drum portion 65 of the cam means 63 is also rotated, so that the guide 87 of the actuation plate 85 engaged in this grooved cam 66 is slidingly moved back and forth intermittently along the shape of the grooved cam 66 in a predetermined cycle. As the guide 87 moves back and forth, the actuation plate 85 on which this guide 87 is formed also moves back and forth, and the support arm 89 which is fixed to the actuation plate 85 through the spacer 88 and the coil spring 91 moves back and forth as well. Further, as the support arm 89 moves interlockingly back and forth, the sliding clutch means 81 having the circumferential groove 82 in which the fork 92 of the support arm 89 engages, is also interlocked and moved back and forth. The sliding clutch means 81 is always engaged with the transmission gear 79. Thus, when the sliding clutch means 81 moves in the direction towards the output gear 74 and engages with the output gear 74, the output of the output gear 74 is transmitted to the transmission gear 79 through the sliding clutch means 81 so as to interlock the relay shaft 75 to which the transmission gear 79 is fixed integrally. Further, as the relay shaft 75 rotates by reason of this interlocking, the crank arm 77 which is fixed to the relay shaft 75 through the link 76 is also rotated, and the up and down piece 35 having the elongated guide groove 78 in which the crank arm 77 is inserted is also interlocked and moved up and down.

Further, as the up and down piece 35 moves up and down, the interlock piece 95 which is coupled to the upper portion of the up and down piece 35 through the connecting rod 97 is also moved up and down, and the arm shaft 93 which is coupled integrally to the base portion of the interlock piece 95 is turned first in one direction and then in the other so that the arm frames 100 which are fixed to both sides of the arm shaft 93 are moved up and down.

As the up and down piece moves up and down, the bellows 39 of the sound producing means 38 which is coupled to the upper end portion of the up and down piece 35 through the connecting rod 37 is contracted and expanded by the up and down motions of the connecting rod 37. This contraction and expansion of the bellows 39 together with the pipe means 43 causes the sound means 38 to mew.

Accordingly, it should be noted that the toy means 9 moves its arms 112 up and down on both sides thereof, while mewing.

When the sliding clutch means 81, actuated by the support arm 89, is moved in the direction away from the output gear 74 and shifted to the transmission gear 79, power is no longer transmitted to the relay shaft 75 from the output gear 74. Accordingly, the relay shaft 75 is not rotated, and thus, the up and down movement of the up and down piece 35 is stopped, stopping the up and down motion of both arm means 112 and the mewing sound.

Figure 11:
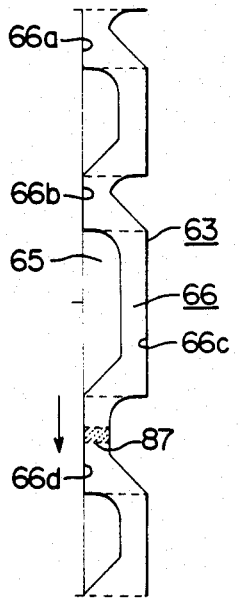
FIG. 11 is an expanded view of a grooved cam.
Figure 16:
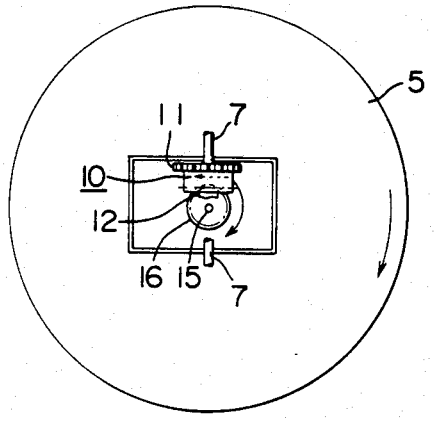
FIG. 16 is a plan view of one portion of a rotary mechanism of a rotary vessel.
Figure 12:
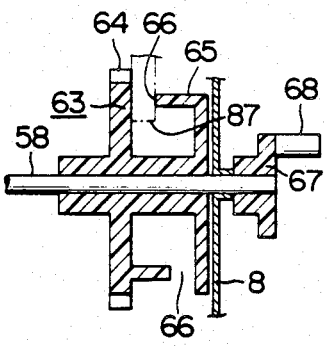
FIG. 12 is a cross-sectional view of a cam means.
Figure 17:
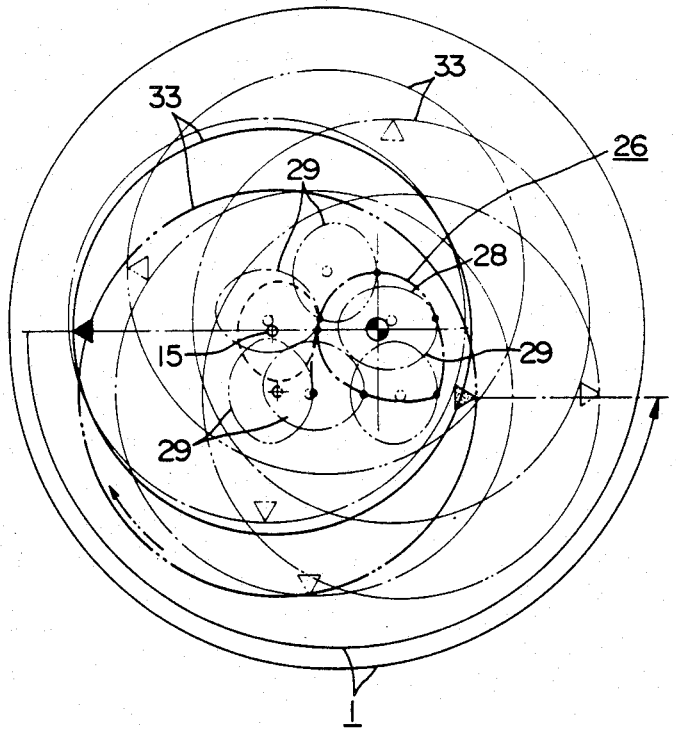
FIG. 17 shows rotation loci of the present playing animal toy.

It should be understood that the power transmission from the output gear 74 to the transmission gear 79 is performed intermittently in a predetermined cycle according to the actuation of the sliding clutch means 81 by the support arm 89. The clutch is actuated according to the relationship between the grooved cam 66 and the guide 87 which engages within the grooved cam 66, thereby causing the arms 112 to move up and down on both sides of the toy means 9 and the sound means 38 to mew intermittently in a predetermined cycle. FIG. 11 shows the expanded view of the grooved cam 66. In the figure, when the guide 87 is shifted from a first groove portion 66*a* to a second groove portion 66*b* of the rotating grooved cam 66, the clutch is interlocked with the motion of the guide 87 and turned on at the first and second groove portions 66*a* and 66*b*. Namely, the sliding clutch means 81 is engaged and interlocked with the output gear 74. By this, the toy means 9 moves the arm means 112 up and down on both sides several times and the sound means mews several times interlockingly with said up and down motion. Next, when the guide 87 is shifted from the second groove portion 66*b* to a third groove portion 66*c* which is formed on the opposite outer side, the clutch is interlocked with the motion of the guide 87 and turned off. Namely, the sliding clutch means 81 disengages from the output gear 74, so that the up and down motion of the arm means 112 on the both sides is stopped and the mewing sound is also stopped. Further, when the guide 87 is shifted from the third groove portion 66*c* to a fourth groove portion 66*d* which is formed on the opposite inner side, the clutch is interlocked with the motion of the guide 87 and again turned on. Namely, the sliding clutch means 81 again engages the output gear 74 so that the toy means 9 moves both arm means 112 up and down more times than the above mentioned case, and the sound means mews more times than the above case concurrently with said up and down motion. Each operation mentioned above is switched over from one to the next sequentially and repeated.

FIG. 13 shows the toy means 9 which swings back and forth while being rotated by the counteraction to the swinging motion. In the figure, when the toy means 9 is in the position 9*a* shown by a dot and dash line, it neither moves its arms 112 up and down nor mews. On the other hand, when it comes to the position 9*b* shown by a solid line, it starts to move its arms 112 up and down and to mew.

After repeating each of the above operations in a predetermined period, the toy means 9 is automatically shifted from the inclined position to the upright position by the counteraction to its swinging and rotating motion, and is supported by the bottom surface 28 of the floor engaging means 26 which contacts the floor.

In this case, since the floor engaging means 26 is continuously interlocked with and rotated by the crown gear 12 of the drive gear means 10 through the relay gear 16, when the whole bottom surface 28 comes into engagement with the floor, it is difficult or impossible for the floor engaging means 26 to rotate continuously, due to the frictional resistance between the bottom surface 28 and the floor. When the rotation of the floor engaging means 26 is prevented, it is also impossible or difficult for the relay gear 16, which is coupled to the movable rotary means 26 through the coupling means 20 and the rotary shaft 15, to rotate. In this situation, the crown gear 12 of the drive gear means 10, which remains engaged with the relay gear 16 and continues to be rotated by the interlock gear 61, moves around the relay gear 16 causing the whole body of the cup portion 2 and the saucer portion 1 to be rotated in the reverse of the previous rotating direction, around the rotary shaft 15 and the coupling means 20.

Accordingly, the toy means 9 in the cup portion 2 is rotated with the saucer portion 1 and the cup portion 2 centering around the rotating center a in the reverse of the previous swinging and rotating direction, supported by the bottom surface 28 of the floor engaging means 26 which scarcely rotates.

Further in this case, the output gear 14 of the drive gear means 10 is continuously rotated while the crown gear 12 is rotating, and the cam means 63 is also rotated through the reduction gear 64 which engages with the output gear 14. As the cam means 63 rotates, the power switching mechanism 83 actuates the clutch on and off in a predetermined cycle, as mentioned above, so as to move the up and down piece 35 up and down, interlocking the arm means 112 on both sides of the toy means 9 and the sound means 38 therewith. At the same time, the rotary shaft 58 to which the cam means 63 is fixed is rotated with the rotation of the cam means 63, so as to swing the toy means 9 back and forth with the rotation of the crank arm 68 of the rotary shaft 58.

Figure 15:
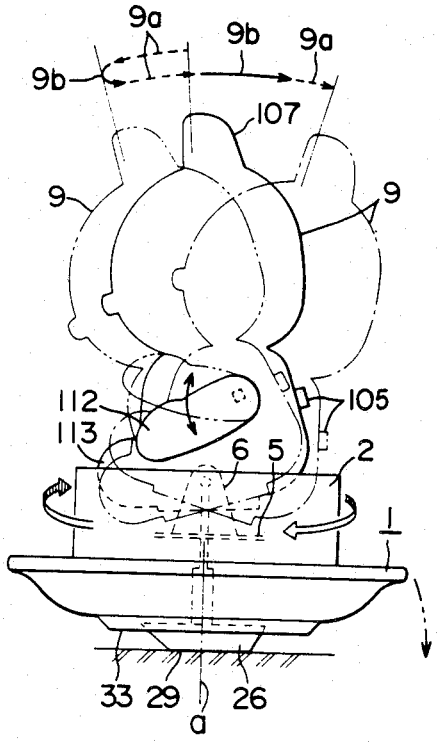

Accordingly, it should be understood that the toy means 9 swings back and forth while moving its arm 112 up and down intermittently in a predetermined cycle, under the condition in which it is rotated nearly horizontally, as shown in FIG. 15. At the same time, it should also be understood that the toy means 9 repeats two different actions intermittently in a prdetermined cycle in accordance with the up and down motion of the arms 112 on both sides thereof. Namely, when the toy means 9 is in the position 9*a* shown by a dot and dash line of FIG. 15, it neither moves its arms 112 up and down nor mews. When it is in the position 9*b* shown by a solid line, it moves its arms 112 and mews several times. The above actions are repeated alternately in a predetermined cycle.

After repeating the above action in a predetermined period, the toy means 9 is again shifted automatically to the inclined position, and the toy means 9, the saucer portion 1, the cup portion 2, and the floor engaging means 26 start the above mentioned various actions, in turn, and repeat each action in a predetermined period.

While the switch 105 is turned on, each operation mentioned above is performed in its turn so that each action is repeated under specified conditions.

EFFECTS OF THE INVENTION

According to the present invention, when the power is fed in, a driving mechanism and a swinging mechanism are actuated, a floor engaging means which is coupled to said mechanisms is rotated swingingly, a toy means is also moved back and forth, and at the same time, a rotary vessel which houses the toy means therewithin is moved back and forth with the motion of the toy means. Since the rotary vessel has a projected ridge on the bottom surface thereof, when the rotary vessel is inclined to one side, one portion of the projecting ridge comes in contact with the floor and one portion of the peripheral edge of the bottom surface of the floor engaging means also comes in contact with the floor, so that the inclined rotary vessel is supported firmly upon said two points. In this case, as the floor engaging means is continuously rotated, the rotary vessel housing the toy means therewithin precisely swings and rotates in the inclined state around each portion of the projected ridge as a turning center. Accordingly, it should be understood that the action of the toy means is effectively transferred to the operation of the rotary vessel, so that the rotary vessel is rotated while being inclined according to the shift of the center of gravity by the swinging motion of the toy means. Thus, the present invention provides a situation in which the toy means, namely, an animal rides in the rotary vessel as a plaything and appears to be enjoying the large swinging and rotating action, apparently controlling the plaything. Further, the rotary vessel is shifted from the inclined state to the upright state according to the relationshp between the counteraction to the swinging motion of the toy means and the position where the peripheral edge portion of the bottom surface of the floor engaging means comes in touch with the floor. The rotary vessel is, then, supported by the bottom surface of the floor engaging means, and at the same time, is rotated automatically in the reverse direction centering around the floor engaging means as the rotation center. Accordingly, the motion of the rotary vessel is shifted from a swinging motion to horizontal rotation. Each said motion is repeated in a prdetermined cycle, thus providing continuously, situations of great interest.

Further, in addition to the above interesting action, the present toy means moves its arm means up and down and mews due to the up and down motion of an up and down mechanism which is interlocked intermittently in a predetermined cycle by the operation of a cam means and a power switching mechanism, thus providing continuously, situations of great interest in which the toy means, namely, an animal rides in a plaything, and moves its arms up and down while mewing loudly during the course of a large swinging and rotating action.

What is claimed is:

1. A playing animal toy comprising:

A. a floor engaging means having a bottom surface area which lies in a single plane for flatwise engagement with an upwardly facing supporting surface and around which there is a peripheral edge;

B. a vessel mounted on said floor engaging means for rotation relative thereto about a substantially upright axis which is spaced radially inwardly from all portions of said peripheral edge, said vessel having a downwardly projecting ridge which surrounds said axis, is larger in diameter than said peripheral edge and is spaced above said single plane;

C. power drive means disposed within said vessel and connected between it and said floor engaging means for effecting relative rotation between the vessel and the floor engaging means about said axis;

D. an animal figure disposed within said vessel and swingable relative thereto in opposite directions substantially transverse to said axis; and E. tilting means connected with said power drive means and operative during said relative rotation to tilt the floor engaging means sufficiently out of flatwise engagement with said supporting surface and onto said peripheral edge thereof to bring a portion of said ridge into transient engagement with said supporting surface, for thus imparting gyratory swinging motion to the vessel.

2. The playing animal toy of claim 1 wherein said peripheral edge of the floor engaging means is substantially oval.

3. The playing animal toy of claim 1 wherein said vessel comprises portions in the shape of a cup within which said animal figure is disposed and of a saucer upon which the cup portion is fixed, said ridge being on the bottom of the saucer portion.

4. The playing animal toy of claim 1 wherein said tilting means comprises:

(1) a base shaft within said vessel extending substantially transversely to said axis and constrained to partake of all movement of the vessel;

(2) a support arm projecting substantially radially from said base shaft to be swingable in opposite directions about the base shaft, said support arm having a motion transmitting connection with said figure and having near its outer end a guide hole which is elongated lengthwise of the support arm;

(3) a rotary shaft extending substantially parallel to said base shaft and confined to rotation relative to it, said rotary shaft being drivingly connected with said power drive means to be rotated thereby; and (4) a crank arm coupled to said rotary shaft to be constrained to rotate therewith and having a crank element which is eccentric to said rotary shaft and which is slidably received in said guide hole to translate rotation of said rotary shaft into swinging motion of said support arm.

5. The playing animal toy of claim 1 wherein said power drive means comprises:

(1) an upright shaft coaxial with said upright axis and which is secured at its bottom to said floor engaging means;

(2) a relay gear coaxially fixed to an upper end portion of said upright shaft;

(3) a crown gear confined to rotation relative to said vessel about a second axis transverse to said upright axis and connected with rotating motor means in the vessel to be driven thereby for such rotation, said crown gear being meshingly engaged with said relay gear for effecting relative rotation between said vessel and said floor engaging means about said upright axis.

6. A playing animal toy comprising:

A. a floor engaging member having a substantially oval bottom surface that is adapted to rest on a flat supporting surface;

B. a vessel mounted on said floor engaging member for rotation relative thereto about an upright axis that is near the center of said bottom surface, said vessel having thereon a substantially annular downwardly projecting edge surface which is larger in diameter than said bottom surface, is substantially concentric to said upright axis and lies in a plane which is at a level above that of said bottom surface;

C. an animal figure mounted in said vessel to swing relative thereto in backward and forward directions transverse to said upright axis, said animal figure (1) having a pair of swingable arm portions, one at each of a pair of opposite sides thereof, and (2) having a sound producing mechanism therein;

D. power driven means in said vessel, connected with it and with said figure, for swinging said figure backward and forward relative to the vessel and whereby the vessel and the floor engaging member are tilted backward and forward, substantially in unison with swinging of said figure, for transient engagement of said edge surface with a supporting surface that is also engaged by the floor engaging member;

E. rotation transmitting means connected with said power driven means and with said floor engaging member for effecting relative rotation about said upright axis between said vessel and the floor engaging member whereby said transient engagement produces gyratory swinging of the vessel;

F. cyclically operating mechanism within said figure, (1) having a motion transmitting connection with said arm portions for imparting cyclical swinging motions to the same, and (2) having a connection with said sound producing mechanism whereby the latter is caused to produce a sound during each cycle of swinging motion of the arm portions; and G. intermittent drive means for intermittently connecting said cyclically operating mechanism with said power driven means for actuation of the former by the latter, said intermittent drive means comprising (1) a constantly rotating member driven by said power driven means, (2) a cam constrained to rotation with said constantly rotating member, and (3) clutch means controlled by said cam and whereby said cyclically operating mechanism is alternately drivingly connected with and disconnected from said constantly rotating member.

* * * * *